United States Patent [19]

Schiewe

[11] Patent Number: 4,488,621

[45] Date of Patent: Dec. 18, 1984

[54] EMERGENCY ELEVATOR

[76] Inventor: Herbert L. Schiewe, 6550 Fraser St., Vancouver, British Columbia, Canada, V5X 3T3

[21] Appl. No.: 331,735

[22] Filed: Dec. 17, 1981

[51] Int. Cl.[3] ..... B66B 5/00

[52] U.S. Cl. ..... 187/70; 187/94

[58] Field of Search ..... 187/6, 8, 68, 70, 94

[56] References Cited

U.S. PATENT DOCUMENTS

| | | | |
|---|---|---|---|
| 298,292 | 5/1884 | Curtis | 187/8 |
| 392,753 | 11/1888 | Read et al. | 187/70 X |
| 407,200 | 7/1889 | Guthrie | 187/67 X |
| 494,217 | 3/1893 | Miles | 187/17 |
| 815,401 | 3/1906 | Breckon | 187/6 |

*Primary Examiner*—H. Grant Skaggs
*Assistant Examiner*—Lawrence J. Miller
*Attorney, Agent, or Firm*—Townsend and Townsend

[57] ABSTRACT

An emergency elevator which has a guided cage and a cylinder with closed ends. Valves communicate with the interior of the cylinder adjacent its ends. An additional valve communicates with the interior of the cylinder at a location between one end of the cylinder and the associated valve. A piston is slidably disposed in the cylinder and connected to the cage so that the downward movement of the cage is restrained. A counterweight is coupled to the cage and is of a sufficient weight to raise the cage when it is empty. The counterweight is conveniently disposed within the cylinder and can be integral with the piston.

6 Claims, 2 Drawing Figures

EMERGENCY ELEVATOR

FIELD OF THE INVENTION

This invention relates to an elevator particularly useful in emergency situations.

BACKGROUND OF THE INVENTION

Various elevators for use in emergency situations have previously been described. For example, U.S. Pat. No. 927,056 to Krasmer describes a fire escape elevator type device wherein the cage rides on rotating worms, the cage being raised by a spring motor which is wound upon descent of the cage. The cage is stopped at any particular level by outwardly protruding arms which contact the top of the cage. No means are apparently provided to control the rate of ascent or descent of the cage which would vary depending upon the load. U.S. Pat. No. 815,401 to Breckon discloses a fire escape elevator type device wherein the elevator is raised by counterweights running in vertically disposed guides. The cage is slowed in its vertical descent by a brake disposed at the top of the elevator mechanism, the controlling cable for the brake running through the cage. This particular device does not suffer from the same relative degree of mechanical complexity as the device disclosed by the patent to Krasmer, although it is still relatively mechanical complex particularly in relation to the pulley mechanism for engaging the brake activating cable. It is desirable to keep such devices which are particularly intended for emergency situations, as mechanically simple as possible in order to minimize the possibility of failure of the system as a result of a failure in one of its mechanical components. The device described in the patent to Breckon in addition to being subject to possible failure of the mechanism for engaging the brakes, is also subject to possible failure of the brake itself, the failure to the brake most likely resulting from overheating.

U.S. Pat. No. 494,217 to Miles describes a pneumatic elevator having a cage connected through a cable and pulley to a piston disposed in a vertically oriented cylinder. The cylinder has relief valves connected to either end, the valve connected to the upper end being capable of allowing air to exit from the upper end of the cylinder upon descent of the elevator, or allowing compressed air from a source of compressed air to enter the upper end of the cylinder in order to raise the cage. Such a device suffers not only from the possibility of failure in the relatively complex valve mechanism required for communication with the upper end of the cylinder, but also from possible failure of the source of compressed air, the source of compressed air described in the patent being a compressor run by a steam powered engine. Obviously, other sources of power could be used to run the compressor. If however, the source of steam or electricity or otherwise should fail during an emergency, the cage of the elevator could not be raised. Furthermore, during emergency situations such as a severe fire, the source of power for the compressor could readily be interrupted.

U.S. Pat. No. 780,711 to Donnell describes a fire escape elevator type device with a relatively complex cage structure designed to rescue occupants of a building from windows of the building adjacent either side of the path of travel of the cage. The device relies upon the strength of individuals located on the ground to control the speed of descent of the cage and also to raise it. The device would require at least two people on the ground and probably three for proper operation. Obviously, it is undesirable to have to rely upon the presence and strength of individuals located on the ground during an emergency situation.

U.S. Pat. No. 407,200 to Guthrie describes an emergency fire escape elevator device wherein the cage is raised by counterweights disposed in vertically oriented tubes, and is controlled in its vertical descent by brakes, the control ropes for which extend through the cage. Pistons are rigidly attached to the cage so as to move up and down within a corresponding direction. These pistons move into corresponding cylinders with an open upper end, the lower end of which is closed and communicates with a valve for gradually releasing air. As a result, the cage is gradually slowed in its descent even if the brake should fail (which as mentioned before can readily happen in heat producing devices such as brakes). The device described by this patent is relatively complex to manufacture, requiring at least one counterweight and a separate guide tube, as well as at least one piston and its corresponding open ended cylinder and also a brake. As well, this particular device does not control the speed of descent of the cage throughout its entire descent, nor does it control the speed of ascent of the cage.

It is desirable then to have an emergency elevator device which is relatively simple to construct so as to have few parts which can malfunction, and which does not depend upon any source of power, including human power. As well, it is desirable to have such a device which has no heat producing components, such as brakes, which may malfunction during an emergency as a result of overheating.

SUMMARY OF THE INVENTION

The emergency elevator of the present invention comprises a cage, guide means for guiding the cage during movement thereof, a cylinder having closed first and second ends and first and second end portions adjacent thereto respectively, and first and second valves. The first and second valves communicate with the interior of the cylinder adjacent the first and second end portions thereof respectively, each of these valves restricting fluid flow into and out of the cylinder. A third valve is also provided which communicates with the interior of the cylinder between the first end of it, and the position at which the first valve communicates with the interior of the cylinder. The elevator also comprises a piston slidably disposed in the cylinder and a coupling means. The coupling means is connected between the piston and the cage for reversibly moving the piston in a direction corresponding to, and in response to, a direction moved vertically by the cage so as to restrain downward movement thereof. In addition, the elevator also comprises a counterweight coupled to the cage so as to raise the cage when empty to an uppermost position thereof.

The elevator advantageously comprises a cage, guide means for guiding the cage during movement thereof, and an upwardly disposed cylinder having a closed first end and a first end portion adjacent the first end, and an open second end. The elevator also usefully comprises a first valve communicating with the interior of the cylinder adjacent the first end portion of it and which restricts fluid flow into and out of the cylinder, a piston slidably disposed in the cylinder, coupling means, and a counterweight. A third valve as previously described is also provided. The coupling means is connected between the cage and an upper side of the piston for reversibly moving the piston in a vertical direction opposite that moved by the cage and in response to a vertical movement thereof, so as to restrain downward movement of the cage. The counterweight is disposed in the cylinder adjacent the piston and attached thereto, so as to raise the cage when empty to an uppermost position thereof.

Usefully, the cylinder has closed first and second ends, first and second end portions adjacent thereof respectively, and first, second and third valves as described.

Advantageously, the elevator additionally comprises a fourth valve. The fourth valve communicates with the interior of the cylinder between the second end thereof, and the position at which the second valve communicates with the interior of the cylinder. The fourth valve restricts fluid flow into and out of the cylinder.

The elevator may usefully have locking means positioned in the cage for releasably locking the cage in the uppermost position thereof.

The counterweight is usefully made integral with the piston. As well, the counterweight may usefully be made integral with the piston, and the guide means of the elevator vertically disposed.

Of the various possible coupling means which may be used, the preferred coupling means comprises a pulley rotatably mounted above the uppermost position of the cage, and a cable connected between an upper side of the cage and an upper side of the piston and over the pulley.

Advantageously, the counterweight is made integral with the piston, and the guide means and the cylinder are vertically disposed, and the coupling means comprises a pulley, and a cable. The pulley is rotatably mounted above the uppermost position of the cage, and the cable is connected between an upper side of the cage and an upper side of the piston and over the pulley.

DRAWINGS

An embodiment of the invention will now be described with reference to the drawings, in which:

FIG. 1 is a perspective view of an elevator of the present invention attached to the side of a building; and FIG. 2 is an enlarged, partially cut away view of the cylinder showing the piston and counterweight.

DESCRIPTION OF THE PREFERRED EMBODIMENTS

Figure 1:
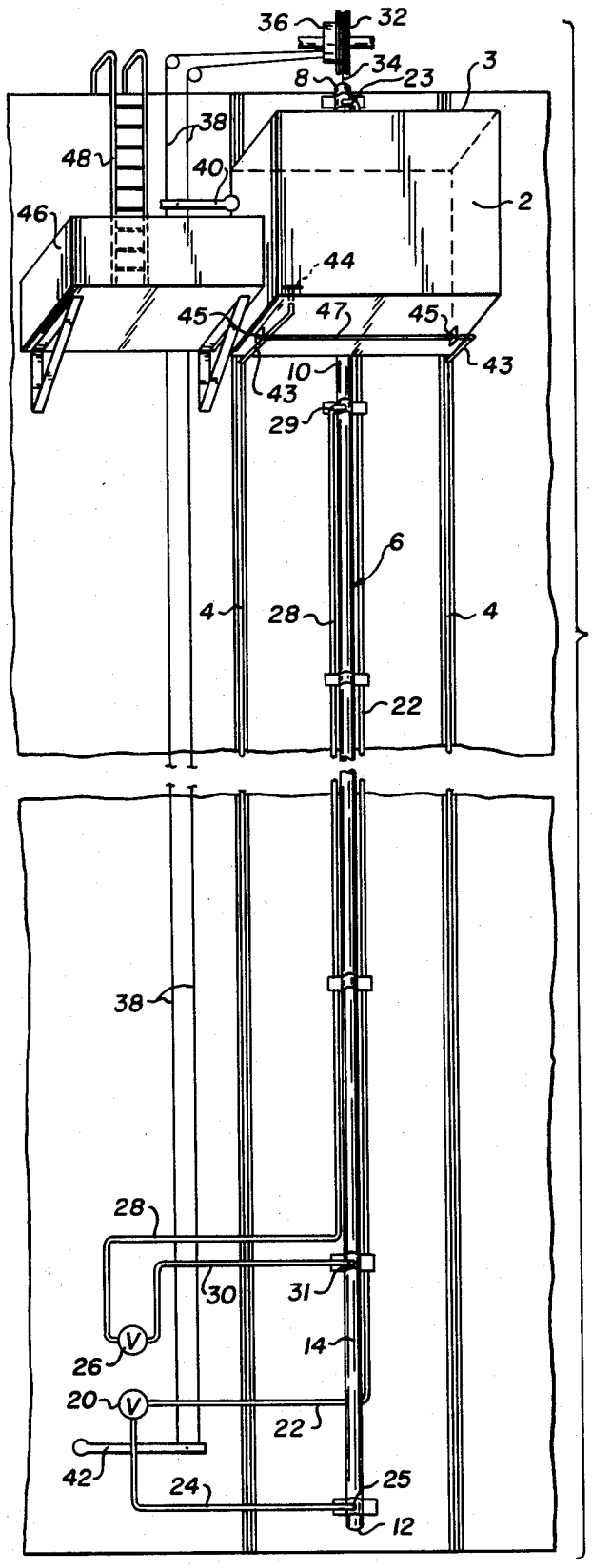
Figure 2:
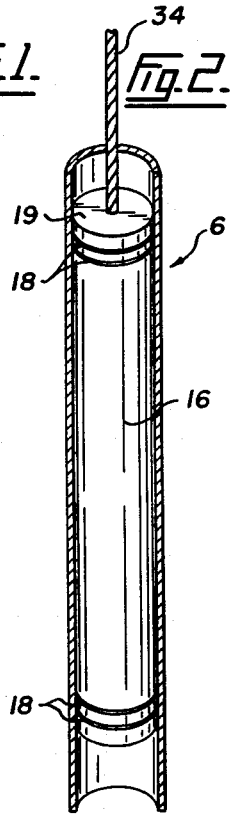

The embodiment of the invention shown in FIGS. 1 and 2 includes a cage 2 which rides on vertically disposed tracks 4 fastened to a building. The tracks 4 act as a guide means for guiding the cage 2 during the movement of the cage 2. The tracks 4 maintain the cage 2 a sufficient distance outward from the building so as to allow room for the vertically disposed cylinder 6. This cylinder has a closed first end 8 and a closed second end 12, and a first end portion 10 adjacent the first end 8 and a second end portion 14 adjacent the second end 12. A double acting valve 26 consists of a first and second valve connected together so as to be operable simultaneously through a common control. The first valve communicates through line 28, with the interior of the cylinder 10 at a position 29 adjacent the first end portion 10 of the cylinder 6. The second valve communicates through line 30 with the interior of the cylinder 6 at a position 31 adjacent the second end portion 14 of the cylinder 6. The first valve of the double acting valve 26 connects lines 30 and 28 to the atmosphere through an internal valve mechanism to permit simultaneous control of the rate at which air can be vented from the interior of the cylinder 6 at positions 29 and 31. A double acting valve 20 consists of a third and fourth valve connected together so as to be operable simultaneously through a common control. The third valve of double acting valve 20 communicates through line 22 with the interior of the cylinder 6 at a position 23 between the first end 8 of the cylinder 6, and the position 29 at which the first valve in double acting valve 26 communicates with the interior of the cylinder 6. The fourth valve of double acting valve 20, communicates through line 24 with the interior of the cylinder 6 at a position 25 between the second end 12 of cylinder 6, and the position 31 at which the second valve in double acting valve 26, communicates with the interior of the cylinder 6. Double acting valve 20 permits simultaneous control of the rate at which air can escape from the interior of the cylinder 6 at the positions 23 and 25. All of the valves are conveniently of the adjustable needle type so as to adjustably restrict fluid flow (in this case the fluid being air), into and out of the cylinder.

An intergral piston-counterweight 16 (which shall henceforth in this Disclosure be referred to as the piston 16 or the integral piston-counterweight 16) is slidably disposed in the cylinder 6. The piston 16 has rings 18 disposed at either end of it to provide a relatively good airtight seal at either end of the piston 16 against the cylinder 6. A cable 34 is connected between an upper side 19 of the piston 16 and an upper side 3 of the cage 2. The cable 34 passes over a pulley 32 which is connected to the building by mounting means (not shown in detail) so that the pulley 32 is disposed above the uppermost position of the cage 2 (the uppermost position of the cage 2 being that position occupied by the cage 2 as shown in FIG. 1). The pulley 32 and the cable 34 together make up a coupling means which together reversibly moves the piston 16 in a vertical direction opposite that moved by the cage 2 and in response to a vertical movement of the cage 2, so as to restrain downward movement of the cage 2. That is, when the cage 2 moves downward on the tracks 4, the piston 16 moves upwards, and vice versa. Strictly speaking perhaps, when the cage moves upward and the piston 16 moves downward, the piston 16 is being moved downward as a result of the force of gravity. However, as the cable 34 is attached to the upper surface 19 of the piston 16, and as the piston 16 cannot move downward without the end of the cable 34 connected to the upper side 19 of the piston 16 moving downward also, in this sense the cable 34 can be said to move the piston 16 downward when the cage 2 moves upward.

The counterweight which as mentioned previously is integral with the piston 16, is of a sufficient weight so as to raise the cage 2 when the cage 2 is empty to the uppermost position of the cage 2. In practice, this will mean that the integral piston-counterweight 16 will have to be of a weight sufficiently greater than cage 2 to overcome frictional resistance in the various components of the elevator.

A foot pedal 44 is positioned on the floor of the cage 2 and is connected by rods 43 and 47, to two pawls (not shown) each of which is disposed in a corresponding track 4 and is biased by a spring to normally engage in a slot within the track 4. The rod 47 is mounted on pivot points 45 so that when the foot pedal 44 is pressed, the pawls will retract from the slots and allow the cage to descend. The springs are of sufficient strength so as to cause the pawls to engage in the slots in the tracks when again aligned therewith, and at the same time return the foot pedal 44 to its position before pressing. The foot pedal 44, rods 43 and 47, pivot points 45, and the pawls and slots in the tracks 4 act as the locking means for releasably locking the cage 2 in its uppermost position.

The elevator as shown in FIGS. 1 and 2 also includes a back up brake 36 connected to control cables 38 to control levers 40 and 42. The brake 36 is connected to slow or stop rotation of the pulley 32 in response to control from the control levers 40 and 42 to the control cables 38. Pulling down on control lever 42 or pushing up on control lever 40 will activate the brake 36 to the desired degree.

In operation, individuals desiring to escape a building in an emergency situation can descend from the roof via a ladder 48 to the platform 46. These individuals can then enter the cage 2. When a sufficient number of occupants are present in cage 2, the pedal 44 can be depressed to release the pawls from the slots in the tracks 4 thereby permitting the cage 2 to move downward. When cage 2 moves downward, as a result of the action of the cable 34 on the piston 16, the piston 16 moves upward in the cylinder 6. Due to the relatively tight seal obtained by the rings 18, air above the upper side 19 of the piston 16 in such a circumstance will tend to be compressed. Such compressed air can escape from the interior of the cylinder primarily at position 29 through line 28 and the first valve in double acting valve 26, and hence into the atmosphere. As well, depending upon the position of adjustment of double acting valve 20, a portion of the previously mentioned compressed air may be able to escape from the interior of the cylinder 6 at position 23 through line 22 and hence through the third valve contained in double acting valve 20. As a result of the controlled flow of the compressed air through the first and third valves, downward movement of the cage 2 will be restrained by an amount determined primarily by the cross sectional area of the piston 16 and the adjustment of the valves 26 and 20. In addition, a vacuum will be created below the lower surface of the piston 16. Air will be able to bleed into the interior of the cylinder 6 below the lower surface of the piston 16 at positions 31 through line 30 and the second valve contained in the double acting valve 26. A smaller portion of air may be able to bleed into the cylinder 6 at position 25 through the line 24 and the fourth valve contained in double acting valve 20, this portion, if any, depending upon the setting of the double acting valve 20. As the cage 2 approaches a lowermost position adjacent the ground, the upper surface 19 of the piston 16 will pass position 29. As a result, compressed air can only escape above the upper surface 19 of the piston 16 from the position 23, through line 22, and the third valve contained in the double acting valve 20. Double acting valve 26 may be manually adjusted at this point to prohibit air from entering the cylinder 6 at position 29, or double acting valve 20 can be preferably pre-adjusted so that the third valve restricts the rate at which compressed air above the upper surface 19 of the piston 16 can escape from the interior of the cylinder 6 to such an extent that the rate of ascent of the piston 16, and hence the rate of descent of the cage 2, is restrained even further when the upper side 19 of the piston 16 passes the position 29. Thus, a decrease in the rate of descent of the cage 2 is automatically provided when double acting valves 26 and 20 are properly adjusted.

Preferably, at the lowermost position of the cage 2 adjacent the ground, the last occupant should jump out of the cage 2 rather than stepping out to avoid the situation where he is caught with one foot on the ground and one foot in the cage 2 when the cage 2 begins its ascent as a result of the descent of the intergral piston-counterweight 16. When the piston 16 begins its descent in the cylinder 6, air is compressed below the lower surface of the piston 16 and can leave the interior of the cylinder 6 primarily at position 31. Air can enter the cylinder 6 above the upper side 19 of the piston 16 initially at position 23 through line 22 and the third valve contained in double acting valve 20, and then at position 29 through the first valve contained in double acting valve 26. As a result of compression of air below the lower surface of the piston 16 and the controlled vacuum created above the upper surface 19 of the piston 16, the cage 2 is restrained in its upward ascent. The degree of restraint being determined again by adjustment of double acting valves 26 and 20. When the lower surface of the piston 16 passes position 31, compressed air below the lower surface of the piston 16 will only be able to leave the interior of the cylinder 6 at position 25, through line 24 and the fourth valve contained in double acting valve 20. Preferably, double acting valve 20 is preadjusted so that the fourth valve contained therein allows significantly less air to escape from the interior of the cylinder 6 than the third valve contained in double acting valve 26. As a result, when double acting valves 26 and 20 are properly adjusted, the cage 2 is controlled in its upward and downward movement in a manner which allows the cage to move at a controlled speed between the upper portion 10 and lower portion 14 of the cylinder 6, and at an even slower speed at the upper portion 10 and lower portion 14 themselves. Thus, a cushion affect is obtained prior to the cage coming to a halt at its uppermost or lowermost position.

When the cage has reached its uppermost position, the locking means engages to halt the cage 2 in that position so that other occupants can then use the elevator for an emergency escape. Should for any reason the air seal created by rings 18 in the cylinder 6 fail, or the cable 34 fail, the standby brake system can also be used to operate the device. By pressing on lever 42, an operator on the ground can control the rate of descent of the cage 2 and bring it to a halt at ground level. As well, such an operator can control the rate of ascent of the cage 2. Control 40 permits an operator in the cage to retain the cage 2 in its uppermost position should the locking means fail, simply by pushing up on the control 40. When it is desired to let the cage 2 descend when such locking means has failed, control 40 may simply be released by such an operator in the cage 2. However, when the elevator is properly operated and the double acting valves 26 and 20 have been properly adjusted, except for depression of foot pedal 44 to activate the locking means, the entire operation of the elevator will be automatic. If desired though, manual adjustment of the double acting valve 26 and 20 can be made by an operator on the ground to compensate for various loads in the cage 2.

Various modifications can of course be made to the above embodiments.

For example, a fluid such as a liquid could be used instead of simply using air. In such a situation though, it is to be understood that a reservoir of fluid must be supplied for use with the elevator and connected in a manner obvious to those skilled in the art.

As will be apparent to those skilled in the art in light of the foregoing disclosure, any alterations and modifications are possible in the practise of this invention without departing from the spirit or its scope thereof. Accordingly, the scope of the invention is to be construed in accordance with the substance defined by the following claims.

I claim:

1. An elevator comprising:

(a) a cage;

(b) guide means for guiding said cage during movement thereof;

(c) an upwardly disposed cylinder having closed first and second ends and first and second end portions adjacent thereto respectively;

(d) first and second valves communicating with the interior of said cylinder adjacent the first and second end portions thereof respectively, each of said valves restricting fluid flow into and out of said cylinder;

(e) a third valve communicating with the interior of said cylinder between the first end thereof and the position at which said first valve communicates with the interior of said cylinder, said third valve restricting fluid flow into and out of said cylinder;

(f) a piston slidably disposed in said cylinder;

(g) coupling means connected between said piston and said cage for reversibly moving said piston in a direction corresponding to, and in response to, a direction moved vertically by said cage so as to restrain movement thereof;

(h) a counterweight coupled to said cage, of sufficient weight so as to raise said cage when empty to an uppermost position thereof; and (i) a fourth valve communicating with the interior of said cylinder between the second end thereof and the position at which said second valve communicates with the interior of said cylinder, said fourth valve restricting fluid flow into and out of said cylinder.

2. An elevator as described in claim 1 additionally comprising locking means positioned in said cage for releasably locking said cage in the uppermost position thereof.

3. An elevator as described in claim 1 wherein said counterweight is integral with said piston.

4. An elevator as described in claim 1 wherein said counterweight is integral with said piston and wherein said guide means are vertically disposed.

5. An elevator as described in claim 1 wherein said coupling means comprises a pulley rotatably mounted above the uppermost position of said cage, and a cable connected between an upper side of said cage and an upper side of said piston and over said pulley.

6. An elevator as described in claim 1 wherein said counterweight is integral with said piston, and said guide means and said cylinder are vertically disposed, and wherein said coupling means comprises a pulley disposed above the uppermost position of said cage, and a cable connected between an upper side of said cage and an upper side of said piston and over said pulley.

* * * * *